United States Patent [19]

Bukaitz

[11] 4,077,686

[45] Mar. 7, 1978

[54] PREFABRICATED METAL STORAGE CABINETS

[75] Inventor: Finley M. Bukaitz, Clifton, N.J.

[73] Assignee: Kero Metal Products Co., Inc., Carlstadt, N.J.

[21] Appl. No.: 757,972

[22] Filed: Jan. 10, 1977

[51] Int. Cl.[2] ..... A47B 87/00

[52] U.S. Cl. ..... 312/257 SM; 312/257 R; 312/257 SK; 312/107

[58] Field of Search ..... 312/257 R, 257 A, 257 SK, 312/257 SM, 107

[56] References Cited

U.S. PATENT DOCUMENTS

| | | | |
|---|---|---|---|
| 508,237 | 11/1893 | Pierce | 312/257 R |
| 1,560,922 | 11/1925 | Wege | 312/257 R |
| 1,627,084 | 5/1927 | Fritz | 312/107 |
| 1,782,344 | 11/1930 | Gourley | 312/257 SK |
| 1,975,613 | 10/1934 | Nystrom et al. | 312/257 R |
| 2,323,957 | 7/1943 | Zalkind | 312/107 |
| 3,110,535 | 11/1963 | Anderson | 312/257 SK |
| 3,294,276 | 12/1966 | Kemp et al. | 312/257 R |
| 3,297,383 | 1/1967 | Fay | 312/257 R |
| 3,480,345 | 11/1969 | Torok | 312/257 R |

FOREIGN PATENT DOCUMENTS

| | | | |
|---|---|---|---|
| 190,978 | 9/1956 | Austria | 312/257 R |
| 925,756 | 5/1963 | United Kingdom | 312/257 R |

*Primary Examiner*—Paul R. Gilliam
*Assistant Examiner*—Victor N. Sakran
*Attorney, Agent, or Firm*—Arthur L. Plevy

[57] ABSTRACT

There is disclosed a prefabricated storage module which employs a top and a bottom rectangular pan member, each having a peripheral slot formed integrally therewith. A right and a left side wall panel assembly each having a coupling channel adapted to coact with corresponding coupling channels on a back wall panel. The coupling channels permit a user to slide the side wall panels into the back panels to permit coupling of the right and left side wall panels with the back panel. The coupled side wall and back panels are then inserted into the peripheral slots of the top and bottom pan members and are thus secured within the peripheral slots. Hinged door assemblies can then be added to the side panels and shelves and rods can be included in the inner confines of the assembled structure by suitable bracket assemblies which are spot-welded to the side panels at predetermined locations. The resultant structure is strong as fabricated from a suitable guage furniture steel and is easily and efficiently assembled.

9 Claims, 11 Drawing Figures

10
11
12
13
15
16
17
20
21
22
25
26
27
28
30
31
32
33
34
40
40A
41
42
42A
44
52
53
60
61
62

PREFABRICATED METAL STORAGE CABINETS

BACKGROUND OF INVENTION

This invention relates to prefabricated cabinet assemblies and more particularly to a steel storage module which is easy to assemble.

The prior art is replete with a number of patents and various disclosures relating to prefabricated structures in general.

There also exists a wide number of prefabricated units which can be employed in a home or an office to provide storage use such as coat closets, broom and utility closets and other such typical uses. Many of these modules are fabricated from a relatively heavy corrugated cardboard or wood and are difficult to assemble, are not sufficiently strong for the purposes intended, and do not present a particularly aesthetic appearance.

Many wooden units as well as metal units are sold completely fabricated and hence, have been relatively unsuccessful in the marketplace due to the fact that they take up a great deal of storage space at the selling location as well as in shipping or transport.

There is therefore a need to provide an attractive storage unit which can be easily assembled by a customer while providing a strong structural capability together with an attractive appearance. The unit as prefabricated, due to the nature of the coupling between various component parts of the unit, provides for quick and easy assembly.

The unit can be provided in a number of useful configurations, each one capable of being constructed by employing the coupling techniques to be described herein. Due to the fact that the unit is of a prefabricated type, it can be stored for sale in a relatively small package and therefore, does not unduly burden warehouse or storage space.

As indicated, the unit is preferably constructed from a heavy gauge furniture steel which can be treated by an electrostatic baked enamel technique to provide a wide variety of colors for the consumer.

DESCRIPTION OF PREFERRED EMBODIMENT

A prefabricated box-like storage module of the type having a closed bottom surface, a closed top surface, a back wall located between said top and bottom surfaces and first and second side walls relatively perpendicular to said back wall with an open front between said top and bottom surfaces and opposite said back wall, comprising top and bottom box-like housing members each having two opposite side walls of relatively equal length and two additional sidewalls perpendicular to said opposite sidewalls, each of relatively equal length to the other, said top and bottom members having a closed surface located between said side walls of relatively the same area and an open end, each of said top and bottom members having a peripheral slot about said opened end with said slot located about both said opposite sidewalls and at least along one of said additional sidewalls, a "U" shaped composite planar member having a right extending arm of a left extending arm relatively equal to the length of said opposite sidewalls with the central arm of said "U" located between said extending arms relatively equal to the length of said additional sidewall, said composite "U" shaped member having one end located within said slot of said bottom housing member and said other end located within said slot of said top housing member to thereby provide a box-like storage module, said "U" shaped composite member further having at least one continuous coupling channel directed between said top and bottom housings for coupling at least a first predetermined planar portion of said "U" shaped configuration to another predetermined planar portion to form said composite "U" shaped member as positioned between said top and bottom housings.

DETAILED DESCRIPTION OF THE FIGURES

Figures 1, 2, 3, 3A, 4, 5:
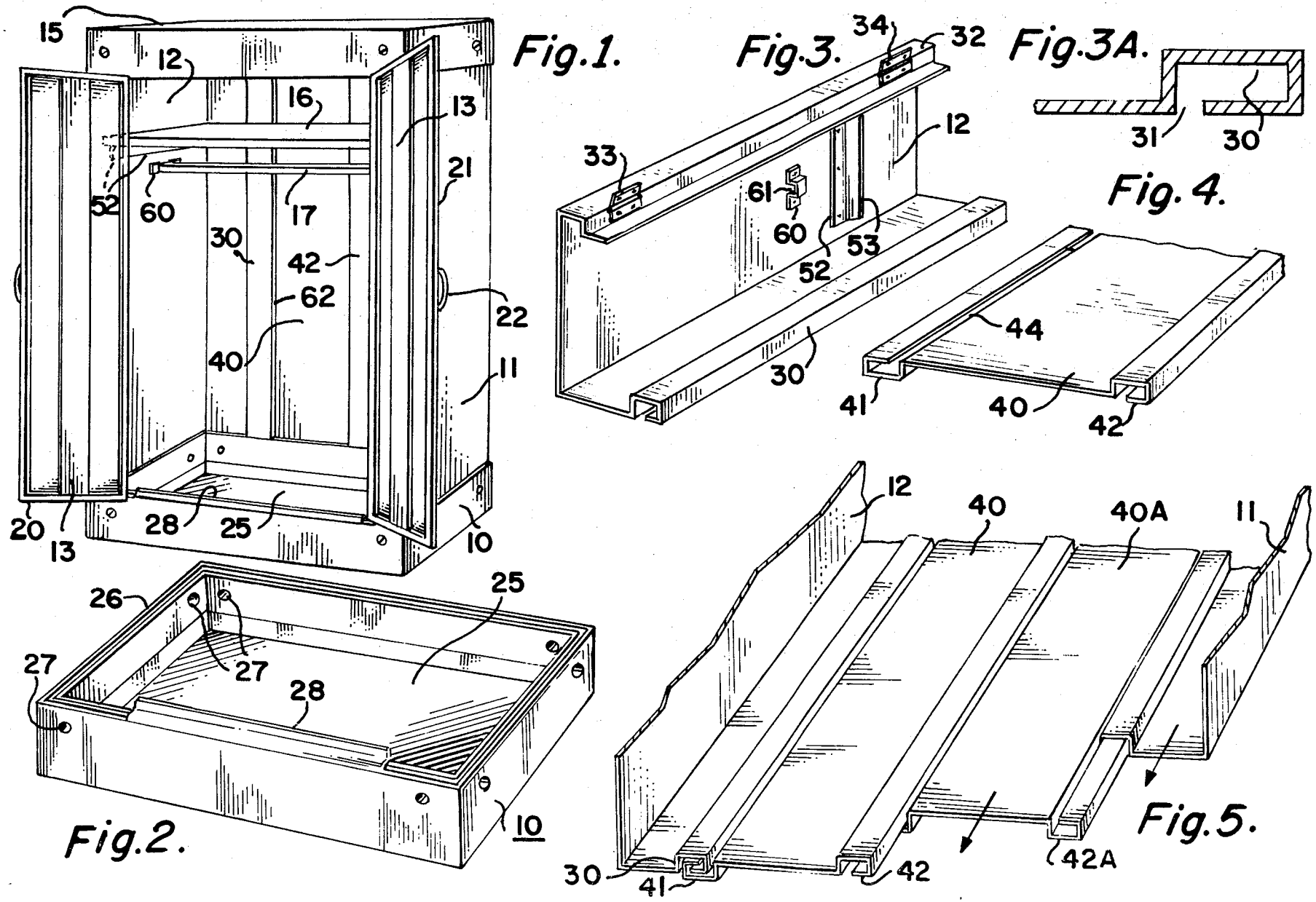
FIG. 1 is a prespective view of a storage module assembly according to this invention.
FIG. 2 is a perspective view of a bottom or top pan assembly depicting the peripheral coupling slot.
FIG. 3 is a perspective view of a side panel assembly according to this invention.
FIG. 3A is a partial cross-sectional view showing the nature of a coupling channel employed in this invention.
FIG. 4 is a perspective view of a back panel assembly employing a right and a left coupling channel.
FIG. 5 is an assembly view depicting the coupling of side and back panels.

Referring to FIG. 1, there is shown a typical closet assembly which as will be explained, has been prefabricated. Although the closet assembly, as will be described, contains a shelf and a clothes rod, it can of course, be ascertained by those skilled in the art that other internal configurations could be made available by using the techniques to be described. Thus, a plurality of shelves could be employed in lieu of a single shelf as well as other configurations.

Essentially, the unit is fabricated from a number of preformed pieces which are conveniently packaged and shipped requiring a relatively small storage area prior to sale to the consumer.

There is shown a bottom housing section 10. The bottom section 10 is basically a rectangular pan having a closed bottom and an opened top. Surrounding the periphery of the opened top is a slot which is not shown in this figure, but which will be described subsequently.

The bottom section communicates with left and right side sections 11 and 12. Each side section is a right angle member and by means of a suitable coupling technique is joined to a back wall section 40. The back wall section 40 is located between the two side members 11 and 12, and may be formed by two planar sheets as will be described, having suitable coupling channels at each side for coupling a side panel thereto.

As briefly indicated, the side walls 11 and 12 as well as the back walls, are coupled one to the other and are retained within the peripheral slot about the bottom pan section 10. A top housing section 15 is also of a rectangular configuration and is similar to the bottom section 10, but may, as shown, be of a lesser height. The top rectangular section 15 has a peripheral slot about its opened end. Thus, the side sections 11 and 12 as well as the back wall section 40 can be accommodated within the peripheral slot of top housing member 15.

The unit has a pair of doors 20 and 21 which are coupled to the side sections 11 and 12 by means of conventional hinges. Although two doors are shown, it will be understood that one door can be employed as well depending upon the size of the unit to be fabricated.

Shown within the inner compartment of the closet member is a shelf 16 which is prefabricated and is retained between the side walls 11 and 12 by means of a spot-welded shelf support to be described. A clothes rod 17 is also shown and is retained between the side walls by suitable bracket assemblies which are also spot-welded to the side walls at appropriate locations. Each door may also have a handle as 22 which can be fastened on a door by means of holes preformed in the door and suitable coupling screws or bolts as would be known to one skilled in the art.

Thus, the unit as shown in FIG. 1 basically consists of the following parts which, as indicated, are preformed at the factory and packaged in a suitable container to await final assembly by the ultimate purchaser. These units have a bottom pan 10, a right and a left side assembly 11 and 12, two back wall sections 40, a top pan 15, two doors 20 and 21 and handles, a shelf 16 and a clothes rod 17. The nature of the apparatus employed in coupling the component modules together will be explained.

Referring to FIG. 2, there is shown a perspective view of a bottom pan assembly as 10. As indicated, the rectangular pan assembly 10 has a closed bottom surface 25 and an opened top. Each side wall has an integrally formed slot as 26 to accommodate the side sections and the back wall section.

Located about the side walls of the pan 10 may be a series of apertures as 27 which as will be explained, can accommodate screws or bolts to assure permanent and positive coupling.

Also, as shown, and as will be further explained, the front section of the pan 10 has preformed therein, a hemmed edge 28 which is also denoted in FIG. 1. This edge provides a guide for the door and enables a user to quickly determine the front portion of the bottom panel. The slot 26 is preformed about the opened top by a double fold of the pan material and hence, is integrally formed herein.

As indicated above, the top pan 15 is also of a similar configuration as pan 10, but is positioned in the final assembly opposite to the bottom pan 10. It is, of course, noted that the top pan also has a peripheral slot to accommodate the side walls and also possesses an integral front hem or edge as 28 to thus form part of the opening to accommodate the door members 20 and 21 of FIG. 1.

The top and bottom pan members may be rectangular or square in configuration and have opposite sidewalls of equal length to one another. The top pan would be of a congruent configuration to maintain the appearance of the structure depicted in FIG. 1. The slot 26 needs to be formed at least about continuous sides to accommodate the "U" shaped composite side and back wall configuration, but is formed about the four sides to allow the flanged section of the side wall (32 of FIG. 3) to be accommodated. The hemmed edge 28 is formed on the front sidewall of the housing 10 to eventually, with the associated flanges of the side walls, form a frame for access to the closet interior and over which a suitable door or doors may be hinge mounted.

Shown in FIG. 3 is a left side section as 12 of FIG. 1. As indicated, the side section is formed from a guage steel and possesses a right angle bend and thus, has an "L" shaped cross-section. One edge of the side section has a coupling channel 30 integrally formed therewith and along the length of the side section. The coupling channel 30 which is more clearly shown in FIG. 3A is of a rectangular configuration having an opening 31 in the bottom side to enable one to couple a back wall section thereto.

The coupling channel 30 is formed by a rectangular bending of the gauge steel material. The material is bent at right angles as shown and the opening 31 in the bottom wall of the rectangle forms an elongated slot along the edge of the side panel and equal in length to the side wall. As will be explained, an identical mirror image coupling channel can then be emplaced within the channel and another panel can be joined to this panel.

The other end of the side section 12 also has a preformed flange 32 thereon. The flange 32 is formed to provide the door opening and may have prelocated thereon, hinged members as 33 and 34 to accommodate the door.

It is, of course, noted that the right side section 11 is virtually identical to the left side section 12 but is the mirror image, as can be seen from FIG. 1.

FIG. 4 shows a typical back panel assembly which consists of a relatively planar central section 40 having a left coupling channel 41 and a right coupling channel 42. The coupling channels 41 and 42 as can be seen from FIG. 4, are similar to the channel 30 in the side wall 12 and thus, the channels 41 and 42 as will be explained, can be inserted into and retained within a side wall channel or within another corresponding channel. As indicated, the back wall 40 consists of two panels as 40 of FIG. 4.

The coupling channels 41 and 42 are formed by bending the steel planar member 42 at the edges. It is noted that channel 42 corresponds to channel 30 in the sidewall panel, while channel 41 is opposite with the opening slot 44 on the top to allow a coupling channel with the configuration of channel 30 to be coupled thereto as will be shown in FIG. 5.

Referring to FIG. 5, there is shown a construction assembly diagram for the side walls and back panels. The right and left side wall panels 11 and 12 with their corresponding coupling channels are placed alongside the back wall panels 40. The coupling channels as 30 of the side wall panel 12 and 41 of the back wall panel 40 are inserted one into the other and are slid into place as clearly depicted in the FIG. The corresponding back wall panels 40 and 40A are then coupled together via their corresponding channels as 42 and the back wall channel 40A is coupled to the side wall structure 11 via their corresponding channels 42A. Thus, as will be immediately ascertained from FIG. 5, the entire side wall assembly of the closet of FIG. 1 is implemented simply and reliably due to the unique nature of the longitudinal coupling channels as particularly shown in FIG. 3A.

Thus, FIG. 5 shows that the side wall sections and the back panels are interlocked via the coupling channels by sliding the same together employing the coupling as shown. The interlocked side wall panels and back panels form a U-shaped composite configuration. One arm of the "U" is formed by an upstanding edge of a side panel and the back corner 0 is the other edge of the side panel. While two back panels are shown, it is, of course, understood that one or more than two may be employed. The front of the "U" provides an opening for access to the closet or storage module and is surrounded by a flange which is formed by the hemmed edges as 28 in the top and bottom pan members as well as the lip or flange on the side wall panels.

Figure 6:
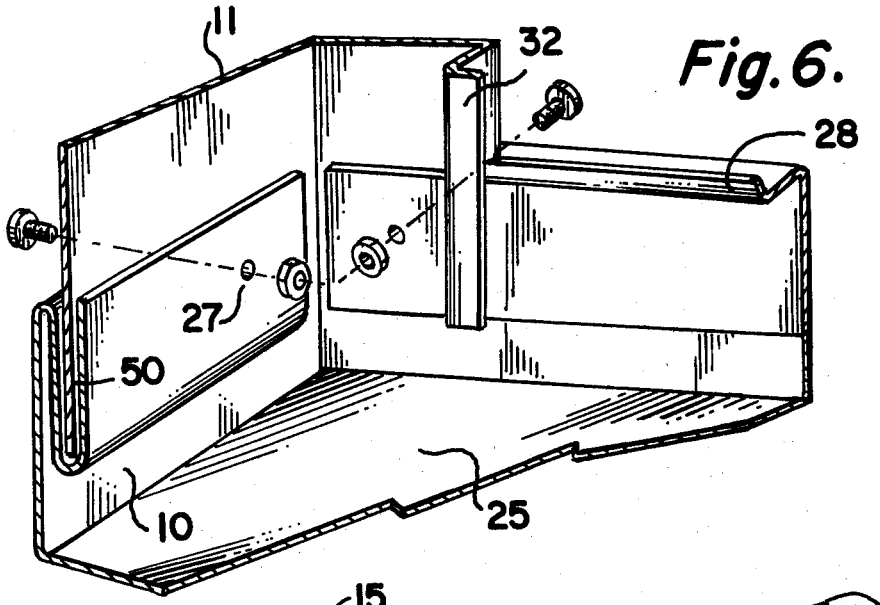
FIG. 6 is a partial assembly view showing the coupling of assembled side and back panels with a top or bottom pan member.

Referring to FIG. 6, there is shown an assembly drawing depicting the coupling of the assembled side and back units of FIG. 5 into a bottom or top pan as 10 of FIG. 2. As indicated, both the bottom and top pans have a peripheral slot of a width sufficient to accommodate the thickness of the assembled panels including the coupling channel sections.

The slot as indicated, is preformed from the pan material by a double fold of the edges of the pan material to provide a serpentine fold to form a U-shaped slot 50 of a width sufficient to accommodate the side wall and back assemblies. Thus, the peripheral edges of the asembled side and back panels are inserted into the slot as shown in FIG. 6 and may be retained therein by means of a nut and bolt assembly directed through the aperture as 27.

The top pan assembly 15 is also employed to cover and retain the assembled side and back wall units. It is noted that the hemmed edge as 28 of the top and bottom pan assemblies as well as the hemmed edge of the side wall assemblies meet to form a rectangular frame opening for the door. The hemmed edge can be formed by a bending of the pan material as was the double folded slot.

Thus, as can be immediately ascertained from FIG. 5 and FIG. 6, the top and bottom pan sections 10 and 15 with their associated peripheral slots are used to retain the assembled side and back wall assemblies as shown in FIG. 1. Upon completion of the assembled steps depicted in FIGS. 5 and 6, a user would be required to emplace the shelf 16 and the clothes rod 17.

Figure 7:
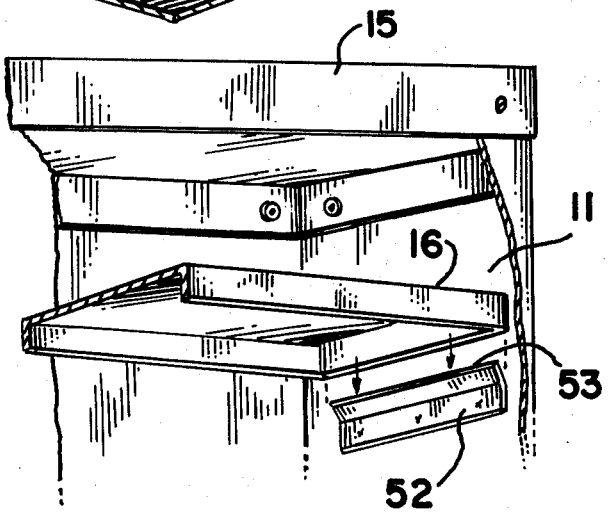
FIG. 7 is a diagrammatic view showing the coupling of a shelf to a side wall assembly.

Referring to FIG. 7, each side has one or more shelf support brackets 52 welded thereto. The shelf support bracket is merely an integral piece of metal with a bent top end 53. The base of the metal is welded directly on the inside of a side member as 12 at an appropriate location.

Figure 8:
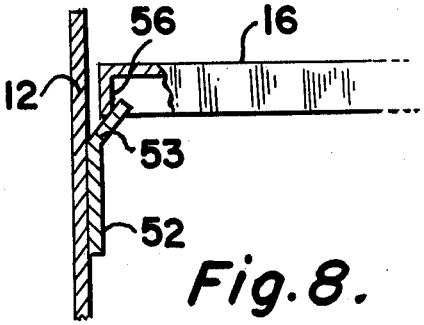
FIG. 8 is a side view of the shelf coupling arrangement.

The shelf 16, as shown, is preformed and has a flanged end 56 which slides or rests directly within the recess formed by the bent portion of the shelf support bracket 52. This particular aspect is shown in cross-sectional view in FIG. 8. Thus, the shelf 16 is firmly held by the mechanism shown between the two side walls.

Figure 9:
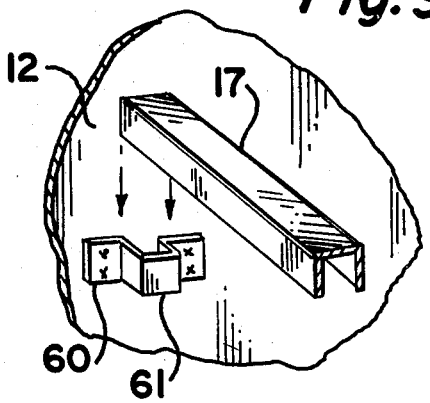
FIG. 9 shows a cross-sectional view depicting the coupling of a clothes rod to a side panel.

FIG. 9 shows the coupling technique for the clothes rod 17. The clothes rod is formed from a strong structural steel and has a U-shaped cross-section. Spot-welded to a side wall as 12 in an appropriate location, is a preformed bracket 60 which has a central extending portion 61 adapted to coact with the "U" channel in the rod 17. There is one bracket as 61 on each side wall to thus retain the rod 17 within the closet.

Figure 10:
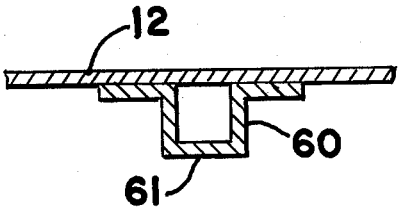
FIG. 10 shows a top view depicting the nature of a coupling closet rod bracket.

FIG. 10 shows a top view of the bracket as welded to a side wall as 12. It is clear that the U-shaped bracket can rest upon section 61 and be retained thereby.

There has thus been shown a simple prefabricated closet assembly which can be easily fabricated and assembled to provide a rugged, strong storage module possessing simple lines and an attractive appearance. The addition of the door members as 20 and 21 which are prefabricated can be impelmented by simple hinged assemblies after installation of the rod and shelf. The doors, as shown in FIG. 1, may be reinforced by means of vertical metal stiffeners as 13 and so on.

It is also noted that due to the unique nature of the coupling channels as 30 associated with the side panels and channels as 41 and 42 associated with the back panels, that these coupling channels, once employed to couple the side wall to the back wall, also serve as stiffening members due to the fact as can be clearly seen from the drawings, that there is a doubling of material at each coupling channel location. (See 62 of FIG. 1).

It would also be apparent to one skilled in the art that various other configurations could be implemented by employing the modular sections depicted herein. Thus, as indicated, one may fabricate the units with multiple shelves, rods and so on of various configurations without departing from the techniques and apparatus described above.

I claim:

1. A prefabricated box-like storage module of the type having a closed bottom surface, a closed top surface, a back wall located between said top and bottom surfaces and first and second side walls relatively perpendicular to said back wall with an open front between said top and bottom surfaces and opposite said back wall, comprising:

a. top and bottom box-like housing members each having two opposite side walls of relatively equal length and two additional side walls perpendicular to said opposite side walls, each of relatively equal length to the other, said top and bottom members having a closed surface located between said side walls of relatively the same area and an open end, each member having a peripheral slot about said opened end with said slot located about both said opposite side walls and at least along one of said additional side walls, b. a "U" shaped composite member having a right extending arm and a left extending arm relatively equal to the length of said opposite side walls with the central arm of said "U" located between said extending arms relatively equal to the length of said additional side walls, said composite "U" shaped member having one end located within said slot of said bottom housing member and said other end located within said slot of said top housing member to thereby provide a box-like storage module, said "U" shaped composite member further having at least one continuous coupling channel directed between said top and bottom housings for coupling at least a first predetermined planar portion of said "U" shaped configuration to another predetermined portion to form said composite "U" shaped member as positioned between said top and bottom housings, said "U" shaped member comprising a right side wall section of an "L" shaped configuration having a continuous coupling channel along one edge thereof, a left side wall section of an "L" shaped configuration having a continuous coupling channel along one edge thereof and facing said channel in said right side wall and at least one planar back wall member having a right sided coupling channel along a right edge and a left sided coupling channel along a left edge, for coaction with said channels in said side walls to form with said side walls, a "U" shaped member when said corresponding coupling channels are coacting.

2. The prefabricated storage module according to claim 1 wherein said continuous coupling channel of said side wall section is integrally formed at said edge by a rectangular bending of said side wall material with a partially opened side to form an elongated slot along the length of said side wall; and said associated coupling channel on said planar member being formed by a similar rectangular bending with a partially opened side forming a slot opposite to said side wall slot to permit said coupling channels to interlock to enable the sliding of said side wall panel with respect to said back panel.

3. The prefabricated module according to claim 1 wherein said peripheral slot in said top and bottom box-like housing is integrally formed about said side walls by the double bending of said material to form a "U" shaped integral slot about said periphery.

4. The prefabricated module according to claim 1 further including at least one shelf support bracket welded on an inner surface of said right extending arm of said "U" shaped member and a second shelf support bracket welded on an innner surface of said left extending arm and facing said first bracket to permit a shelf to be supported between said brackets and relatively perpendicular to said arms.

5. A prefabricated storage module or a closet structure, comprising:

a. a bottom box-like housing member having four side walls and a closed bottom end with an open top end, said member having a peripheral slot formed about said open top end, b. a top box-like housing member having four side walls relatively congruent to said side walls of said bottom member, and a closed top end with an open bottom end, said top member having a peripheral slot formed about said open bottom end, c. first and second side wall planar members of an "L" shaped configuration with one arm of said "L" relatively equal to the length of one of said side walls of said box-like member and said other arm having a continuous channel directed from one end to the other end of said member, said first side wall member having one end positioned in said slot in said bottom housing and said other end positioned in said slot of said top housing, with said one arm forming a first side between said top and bottom members and said second side wall member having one end positioned in said slot of said bottom member and said other end positioned in said slot of said top member with said associated one arm forming a second opposite side between said top and bottom members, and d. a back planar member having a first and second coupling means on a first and second side with said first coupling means coupled to said continuous channel in said first side member and said second coupling means coupled to said continuous channel in said second planar member to form a back wall between said side members, with said ends of said back planar member as positioned between said coupling members, located in said slots of said top and bottom members.

6. The storage module according to claim 5 wherein said peripheral slot formed about said top and bottom ends is of a "U" shaped configuration integrally formed with said side walls.

7. The storage module according to claim 5 wherein said continuous channel directed from one end to the other end of said member is integrally formed therewith by a rectangular bending of said side wall material with a partially opened side forming a slot.

8. The storage module according to claim 5 further including a hinged door assembly coupled to one of said side panels at an end furthest removed from said back wall to enable access to the interior of said module.

9. The storage module according to claim 5 including at least one shelf member positioned between said first and second side walls and relatively perpendicular thereto.

* * * * *